US006469623B2

(12) United States Patent
Pattok et al.

(10) Patent No.: US 6,469,623 B2
(45) Date of Patent: Oct. 22, 2002

(54) SMOKE DETECTOR MAINTENANCE AND VERIFICATION TOOL

(75) Inventors: Greg R. Pattok, Holland, MI (US); Brian J. Kadwell, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 0 days.

(21) Appl. No.: 09/770,727

(22) Filed: Jan. 26, 2001

(65) Prior Publication Data

US 2002/0101345 A1 Aug. 1, 2002

(51) Int. Cl.[7] ..... G08B 29/00

(52) U.S. Cl. ..... 340/516; 340/506; 340/514; 340/587; 340/636; 340/679; 340/3.1; 340/3.3; 340/3.32

(58) Field of Search ..... 340/506, 514, 340/516, 531, 532, 533, 577, 587, 593, 636, 680, 679, 3.1, 3.3, 3.31, 3.32

(56) References Cited

U.S. PATENT DOCUMENTS 4,300,133 A * 11/1981 Solomon ..... 340/630

OTHER PUBLICATIONS

*Safe Air Reader* (*SAR*) Instruction Booklet, Revision 1.2, Dec. 1996 ( 1 pg.).

* cited by examiner

*Primary Examiner*—Daryl Pope
(74) *Attorney, Agent, or Firm*—Price Heneveld Cooper DeWitt & Litton

(57) ABSTRACT

A smoke detector verification system, which includes a smoke detector, a portable computer system and an optical receiver, verifies the operation of the smoke detector. The smoke detector includes a light emitting diode (LED) that is periodically modulated to provide status information about the smoke detector. The portable computer system stores the status information that is received from the optical receiver, which is coupled to the portable computer system. The optical receiver receives the status information from the LED and provides the received status information to the portable computer system.

20 Claims, 1 Drawing Sheet

SMOKE DETECTOR MAINTENANCE AND VERIFICATION TOOL

BACKGROUND OF THE INVENTION

The present invention is directed to a smoke detector, and more specifically to a smoke detector verification system for verifying the operation of a smoke detector.

Traditionally, smoke detectors have been tested, using an external test switch/knob or smoke detector spray, to determine whether the smoke detector is properly functioning. By actuating a test switch/knob or spraying a smoke detector spray into a test chamber of the smoke detector, maintenance personnel are able to determine whether the smoke detector is capable of generating an alarm. Historically, building maintenance personnel have traveled from one smoke detector to another smoke detector to verify that each smoke detector is operating properly. Building maintenance personnel have then updated written records to reflect the maintenance history and status of each of the smoke detectors.

Alternatively, some prior art smoke detection systems have coupled each smoke detector to a central fire panel, which has been capable of ascertaining certain information on each individual smoke detector located throughout the building. In buildings that contain smoke detectors that are not coupled to a central fire panel, the low battery condition of a back-up battery for the smoke detector has typically only been detected when the detector provides a chirp, when the battery voltage goes below a certain level. Smoke detectors have generally included a visible status LED that is periodically illuminated to indicate proper operation of the smoke detector. However, commercially available smoke detectors that are not connected to a central fire panel have not provided other information to maintenance personnel.

Thus, when a smoke detector is not coupled to a central fire panel, it would be desirable for the smoke detector to periodically provide various status information in a form that can be electronically captured by maintenance personnel.

SUMMARY OF THE INVENTION

The present invention is directed to a technique for verifying the operation of a smoke detector. The smoke detector periodically modulates an existing light emitting diode (LED) of the smoke detector to provide status information on the smoke detector. The status information can be provided to a portable computer system, for storage, through a port that is coupled to an optical receiver. The optical receiver receives the status information from the LED and provides the received status information to the portable computer system. In another embodiment, the portable computer system is one of a laptop computer system, a notebook computer system and a handheld computer system. The status information includes at least one of a device serial number, an elapsed time since last test, a current smoke level, a number of alarms since production, an elapsed time since last alarm, a battery level, an ambient temperature and selected options.

These and other features, advantages and objects of the present invention will be further understood and appreciated by those skilled in the art by reference to the following specification, claims, and appended drawings.

DETAILED DESCRIPTION OF PREFERRED EMBODIMENT(S)

Figure 1:
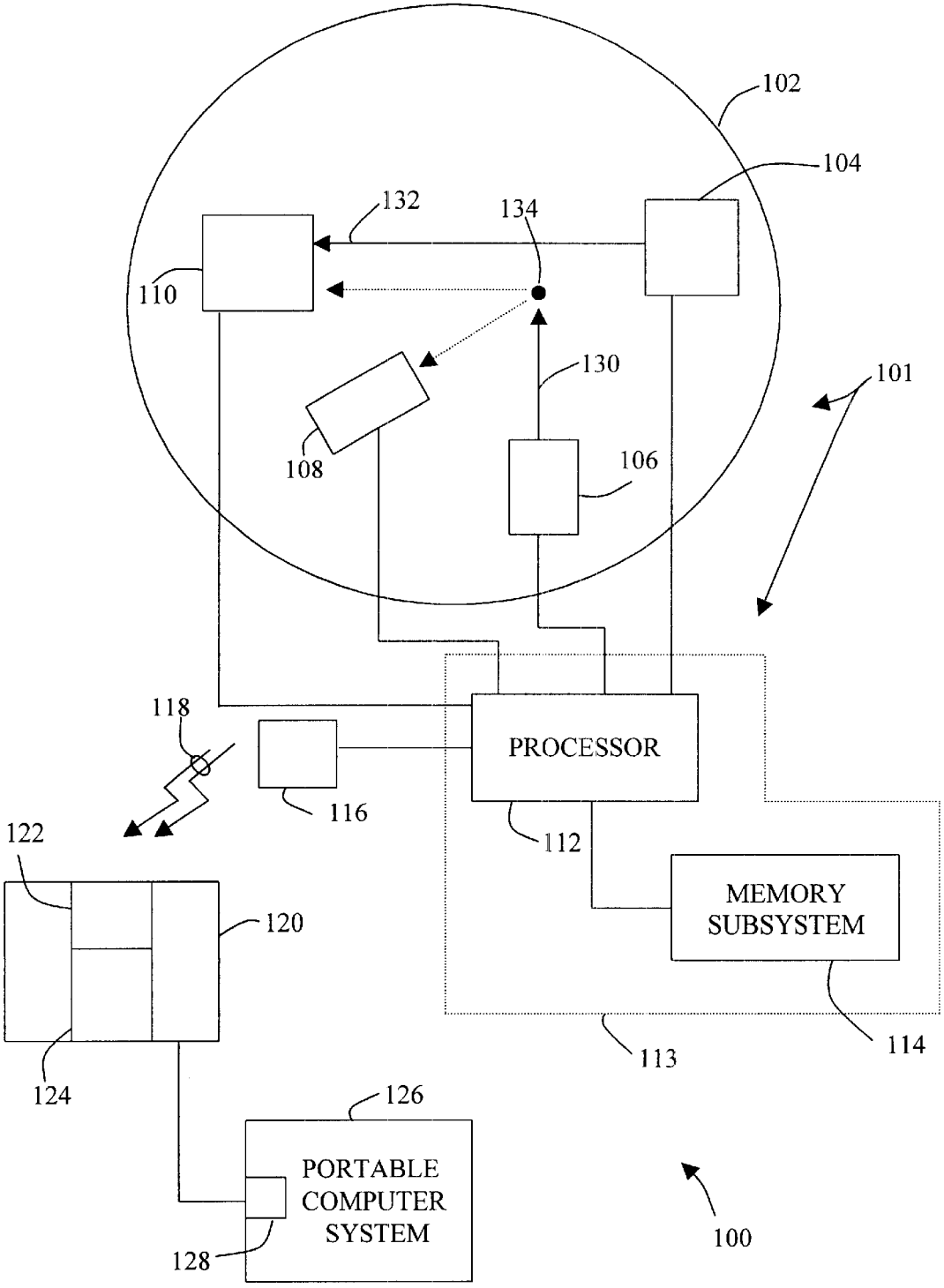
FIG. 1 is an electrical block diagram of a smoke detector verification system that includes a smoke detector that, according to the present invention, provides status information, via an existing LED, to a portable computer system that receives the status information through an optical receiver that is coupled to the portable computer system through a port.

An embodiment of the present invention is directed to a smoke detector verification system that verifies the operation of the smoke detector. The smoke detector includes a light emitting diode (LED) that is periodically modulated to provide status information on the smoke detector. A portable computer system receives and stores the status information through an optical receiver that is coupled to the port of the portable computer system. The received status information can advantageously be stored such that a maintenance log of sensitivity data for a given smoke detector can be maintained. The status information may include a device serial number, an elapsed time since last test, a current smoke level, a number of alarms experienced since production and an elapsed time since last alarm. Other information such as battery level, selected options and ambient temperature may also be transmitted, if desired. Providing the selected options is particularly advantageous from the perspective of an installer, as the installer can determine the installation configuration of the smoke detector without disassembling the detector.

As shown in FIG. 1, a smoke detector verification system 100 includes a smoke detector 101 that provides status information to a portable computer system 126, via an optical receiver 120. The optical receiver 120 includes a photodetector 122 and an amplifier section 124. Preferably, the optical receiver 120 is coupled to an RS232 port of the portable computer system 126. However, it is envisioned that the port 128 can be a universal serial bus (USB) port or an IEEE 1394 port, among other ports. The portable computer system 126 can be of a number of types. For example, the system 126 can be a laptop computer system, a notebook computer system or a handheld computer system, such as a personal digital assistant (PDA).

As shown in FIG. 1, a processor 112 is coupled to a memory subsystem 114. However, one of ordinary skill in the art will appreciate that the processor 112 and the memory subsystem 114 can be incorporated within a microcontroller 113, if desired. The processor 112 is also coupled to an obscuration emitter 104 and scatter emitter 106. Under the processor 112 control, the emitter 104 emits light (e.g., a light ray 132) and the emitter 106 emits light (e.g., a light ray 130). Light emitted from the emitter 104 that is not obscured by a particle (e.g., an exemplary smoke particle 134) within test chamber 102 will strike the light receiver 110.

An output of the receiver 110 is coupled to the processor 112, such that the processor 112 can determine the amount of smoke located within the chamber 102. Periodically, the processor 112 causes the emitter 106 to emit light. A portion of the light (e.g., the light ray 130) may be reflected to the light receiver 108 or the light receiver 110, when the light ray 130 strikes the exemplary smoke particle 134 within the chamber 102. If desired, the light receiver 108 can be omitted from the design, in which case the light receiver 110 is required to detect the portion of the light ray 130 that is scattered from the exemplary smoke particle 134.

The processor 112 is programmed to periodically provide various status information through an existing LED 116. The light rays 118 emitted by the LED 116, when the optical receiver 120 is positioned properly in relation to LED 116, allow the portable computer system 126 to receive the status information. Preferably, the status information is transmitted at a rate of 9600 bits per second with a character format of one start bit, eight data bits and one stop bit. As previously mentioned, the port 128 is preferably an RS232 port. The optical receiver 120 includes a photodetector 122 and an amplifier 124 for amplifying the status information signals to conform to, for example, standard RS232 voltage levels. When the port 128 of the portable computer system 126 is properly configured, the system 126 can read the information from the smoke detector 101, which can then be stored and/or displayed.

The present invention provides maintenance personnel with the ability to measure a smoke detector sensitivity and act to prevent false alarms due to dirty smoke cages. Further, when warranted, the battery within a given smoke detector can be replaced during a regularly scheduled maintenance activity instead of in response to an audible alarm signal. In addition, the source of a trouble indication (e.g., an audible alarm) can be more readily discerned with the portable computer system 126 and the optical receiver 120 of the present invention. Because the smoke detetector 101 of the present invention uses an existing LED 116 instead of adding an additional emitter, e.g., an infrared (IR) transmitter or an RF transmitter, there is no additional component cost to the smoke detector 101. However, it will be appreciated that the processor software must be coded to provide the desired capability. Also, such an additional emitter may nevertheless be provided if desired.

The above description is considered that of the preferred embodiments only. Modification of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A method for verifying the operation of a smoke detector, comprising the steps of:

periodically modulating a light emitting diode (LED) of a smoke detector to provide status information about the smoke detector;

providing a portable computer system to store the status information, the portable computer system including a port; and providing an optical receiver coupled to the port of the portable computer system, the optical receiver receiving the status information from the LED and providing the received status information to the portable computer system.

2. The method of claim 1, wherein the portable computer system is one of a laptop computer system, a notebook computer system and a handheld computer.

3. The method of claim 1, wherein the status information includes at least one of a device serial number, an elapsed time since last test, a current smoke level, a number of alarms since production, an elapsed time since last alarm, a battery level, an ambient temperature and selected options.

4. The method of claim 1, wherein the LED emits visible light.

5. The method of claim 1, wherein the status information is transmitted at a rate of 9600 bits per second.

6. The method of claim 5, wherein the status information is transmitted with a character format of one start bit, eight data bits and one stop bit.

7. The method of claim 1, wherein the port is an RS232 port and the optical receiver includes a photo-detector and an amplifier for amplifying the status information to conform to standard RS232 voltage levels.

8. The method of claim 1, wherein the port is one of an RS232 port, a USB port and an IEEE 1394 port.

9. A smoke detector verification system for verifying the operation of a smoke detector, comprising:

a smoke detector including a light emitting diode (LED) that is periodically modulated to provide status information about the smoke detector;

a portable computer system for storing the status information, the portable computer system including a port; and an optical receiver coupled to the port of the portable computer system, the optical receiver receiving the status information from the LED and providing the received status information to the portable computer system.

10. The system of claim 9, wherein the portable computer system is one of a laptop computer system, a notebook computer system and a handheld computer system.

11. The system of claim 9, wherein the status information includes at least one of a device serial number, an elapsed time since last test, a current smoke level, a number of alarms since production, an elapsed time since last alarm, a battery level, an ambient temperature and selected options.

12. The system of claim 9, wherein the LED emits visible light.

13. The system of claim 9, wherein the status information is transmitted at a rate of 9600 bits per second.

14. The system of claim 13, wherein the status information is transmitted with a character format of one start bit, eight data bits and one stop bit.

15. The system of claim 9, wherein the port is an RS232 port and the optical receiver includes a photo-detector and an amplifier section for amplifying the status information to conform to standard RS232 voltage levels.

16. The system of claim 9, wherein the port is one of an RS232 port, a USB port and an IEEE 1394 port.

17. A smoke detector that provides periodic status information, comprising:

a processor;

a memory subsystem for storing information coupled to the processor;

a light source coupled to the processor;

a light receiver coupled to the processor; and a light emitting diode (LED) coupled to the processor, wherein the LED is controlled by the processor to provide periodic status information about the smoke detector.

18. The system of claim 17, wherein the status information includes at least one of a device serial number, an elapsed time since last test, a current smoke level, a number of alarms since production, an elapsed time since last alarm, a battery level, an ambient temperature and selected options.

19. The system of claim 17, wherein the LED emits visible light.

20. The system of claim 17, wherein the status information is transmitted at a rate of 9600 bits per second.

* * * * *